US011753752B2

(12) United States Patent
Novak et al.

(10) Patent No.: US 11,753,752 B2
(45) Date of Patent: Sep. 12, 2023

(54) MODULAR FLEXIBLE HAND LOOM

(71) Applicant: Authentic Knitting Board LLC, Fort Union, VA (US)

(72) Inventors: Kim Novak, Salem, MA (US); Renita Harvey, Eureka Springs, AR (US); Bill Ziegler, Methuen, MA (US)

(73) Assignee: AUTHENTIC KNITTING BOARD LLC, Fort Union, VA (US)

( * ) Notice: Subject to any disclaimer, the term of this patent is extended or adjusted under 35 U.S.C. 154(b) by 0 days.

(21) Appl. No.: 17/079,156

(22) Filed: Oct. 23, 2020

(65) Prior Publication Data

US 2021/0123169 A1 Apr. 29, 2021

Related U.S. Application Data

(60) Provisional application No. 62/926,115, filed on Oct. 25, 2019.

(51) Int. Cl.
*D03D 29/00* (2006.01)
*D04B 3/00* (2006.01)

(52) U.S. Cl.
CPC ..... *D03D 29/00* (2013.01); *D04B 3/00* (2013.01)

(58) Field of Classification Search
CPC ..... A63H 33/04; A63H 33/046; A63H 33/06; A63H 33/062; A63H 33/065; A63H 33/067; A63H 33/08; A63H 33/084; A63H 33/086; A63H 33/088
USPC ..... 139/29, 34
See application file for complete search history.

(56) References Cited

U.S. PATENT DOCUMENTS 2,433,307 A * 12/1947 Thomas ..... D03D 29/00 28/152
2,451,207 A * 10/1948 Clinton ..... D03D 29/00 28/152
2,663,066 A * 12/1953 Berger ..... D03D 29/00 28/152
4,023,245 A * 5/1977 Zaltzman ..... D03D 29/00 28/152
4,416,040 A 11/1983 Towsley
8,316,894 B2 * 11/2012 Schaub ..... D04B 3/00 139/29

(Continued)

FOREIGN PATENT DOCUMENTS

FR 3087350 A1 * 4/2020 ..... A63H 33/088
WO WO-2005005008 A1 * 1/2005 ..... A63H 33/067

(Continued)

OTHER PUBLICATIONS

Nebilu Wacky Tracks Snap and Click Fidget Toys for Sensory Kids—Snake Puzzles, Assorted Colors, https://www.amazon.com/Neliblu-Wacky-Tracks-Fidget-Sensory/dp/B01N7041YG/ref=sr_1_1_sspa?crid=3QJF3HMP95YHM&dchild=&keywords=neli (5 pages), before applicant's filing date.

*Primary Examiner* — Khoa D Huynh
*Assistant Examiner* — Grace Huang
(74) *Attorney, Agent, or Firm* — Nixon & Vanderhye P.C.

(57) ABSTRACT

A modular hand loom includes a plurality of links having pegs extending from the links. The plurality of links may be connectable with one another to form a plurality of loom configurations for knitting and/or weaving. When the plurality of links are assembled into a desired loom configuration, some links may be configured to remain rotatable relative to an adjacent link thereby causing the loom to be flexible during use.

26 Claims, 11 Drawing Sheets

(56) References Cited

U.S. PATENT DOCUMENTS

| | | | | |
|---|---|---|---|---|
| 9,903,055 | B2 * | 2/2018 | Todokoro | D04B 3/00 |
| 10,077,511 | B2 * | 9/2018 | Novak | D04B 3/00 |
| 10,874,954 | B2 * | 12/2020 | Anderson | A63H 33/067 |
| 10,967,288 | B2 * | 4/2021 | Lin | A63H 33/084 |
| 2008/0223083 | A1 * | 9/2008 | Gustin | D04B 5/00 66/1 A |
| 2013/0252503 | A1 * | 9/2013 | Kwok | A63H 33/062 446/102 |
| 2015/0096643 | A1 * | 4/2015 | Lawrence | D03D 29/00 139/33 |
| 2016/0101371 | A1 * | 4/2016 | Grunewald | A63H 33/06 446/95 |
| 2019/0168129 | A1 * | 6/2019 | Lee | A63H 33/08 |

FOREIGN PATENT DOCUMENTS

| | | | | |
|---|---|---|---|---|
| WO | WO-2008044184 | A2 * | 4/2008 | D03D 29/00 |
| WO | WO-2016053219 | A1 * | 4/2016 | B65D 81/361 |

* cited by examiner

MODULAR FLEXIBLE HAND LOOM

CROSS REFERENCE TO RELATED APPLICATIONS

This application claims the benefit of U.S. Provisional Application No. 62/926,115, filed Oct. 25, 2019, which is incorporated herein by reference in its entirety.

TECHNICAL FIELD

The present technology relates generally to looms for knitting and weaving, and more particularly to modular hand looms.

BACKGROUND

Knitting and weaving have long been popular hobbies and a large variety of items can be made on a loom. A typical loom includes pegs that project from the frame around which the yarn is looped in various ways, such as running back and forth between opposite sides of the frame or from peg to peg around a perimeter of the loom. In order to knit material of different sizes and shapes, adjustable frames and modular looms are desired. However, conventional modular looms typically have relatively large parts and thus the number of loom configurations and shapes is limited. For example, arc-shaped portions in conventional modular looms may be formed in one relatively large piece. Also, once conventional modular looms are assembled, they essentially have the same structure and occupy the same space as one-piece rigid looms.

SUMMARY

One aspect of the disclosed technology relates to a modular hand loom having relatively small pieces (or links) thus allowing for a large number of loom shapes and loom configurations to be created. Since any number of links may be connected together to create a loom, the peg count for a desired loom is essentially limitless.

Another aspect of the disclosed technology relates to a modular flexible loom comprising a plurality of links connected to another and allowing for relative movement between adjacent links once assembled and during use.

Another aspect of the disclosed technology relates to a modular flexible loom that may be arranged into a closed loop configuration for knitting, then disconnected during knitting without removing the partially knitted material from any of the pegs such that the loom pieces are arranged substantially linearly for easy measuring of the width of the partially knitted material, and then reconnected into the closed loop configuration for completion of knitting.

Another aspect of the disclosed technology relates to a method of knitting with a modular flexible loom comprising arranging the loom into a closed loop configuration for knitting, then disconnecting the loom during knitting without removing the partially knitted material from any of the pegs such that the loom pieces are arranged substantially linearly for easy measuring of the width of the partially knitted material, and then reconnecting the loom into the closed loop configuration for completion of knitting.

Another aspect of the disclosed technology relates to a modular hand loom kit comprising at least four links, and the at least four links can be connected together to form a plurality of different closed loop loom configurations. In other examples, the kit may comprise at least eight links that can be connected together to form a plurality of different closed loop loom configurations.

Another aspect of the disclosed technology relates to a modular hand loom, comprising a plurality of links having pegs thereon, the plurality of links being connectable with one another to form a plurality of loom configurations for knitting and/or weaving. Each link may have a first end with a first connector and a second end with a second connector, and each first connector may be removably connectable to the second connector of an adjacent link. The plurality of links includes a first link and a second link, and the first link may be rotatable relative to the second link when directly connected to the second link. When the plurality of links are assembled into a desired loom configuration, the first link may be configured to remain rotatable relative to the second link such that the relative positioning of the pegs on the first link is continuously changeable relative to the positioning of the pegs on the second link thereby causing the loom to be flexible during use.

Another aspect of the disclosed technology relates to a modular hand loom, comprising a plurality of links having pegs thereon for knitting and/or weaving. Each link may have a first end with a first connector and a second end with a second connector, and each first connector may be removably connectable to the second connector of an adjacent link. Each link may be configured to be directly removably connectable to each other link. Each link may have four or less (e.g., 2 or less) pegs thereon, and every peg on each link may be linearly arranged with the other pegs on the link. The plurality of links may comprise at least four (e.g., at least eight) links, and the at least four (e.g., at least eight) links may be connected together to form a plurality of different closed loop loom configurations. The pegs on each link may be fixedly attached to the link prior to the plurality of links being formed into one of the different closed loop loom configurations.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various embodiments of this technology. In such drawings.

DETAILED DESCRIPTION OF ILLUSTRATED EXAMPLES

The following description is provided in relation to several examples (most of which are illustrated) which may share some common characteristics and features. It is to be understood that one or more features of any one example may be combinable with one or more features of the other examples. In addition, any single feature or combination of features in any of the examples may constitute additional examples.

Figure 6:
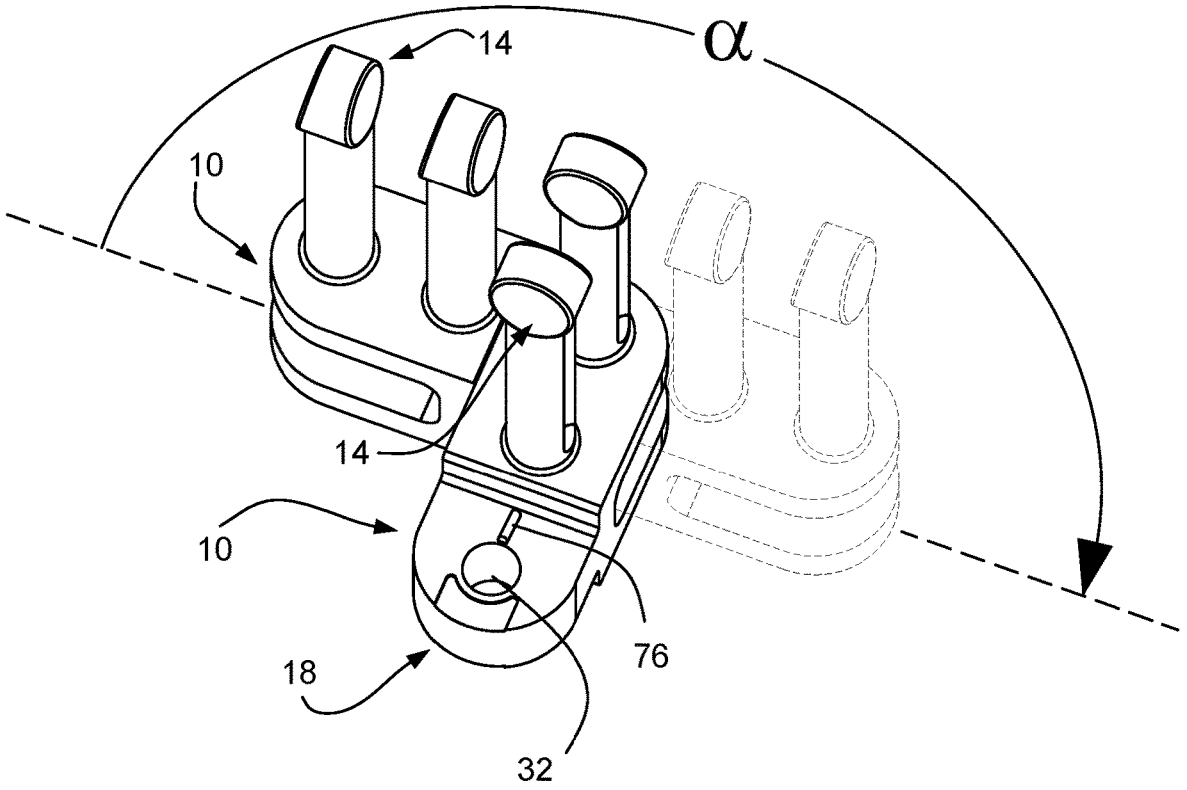
FIG. 6 is a top perspective view showing a rotatable connection between two links according to an example of the disclosed technology.
Figure 7:
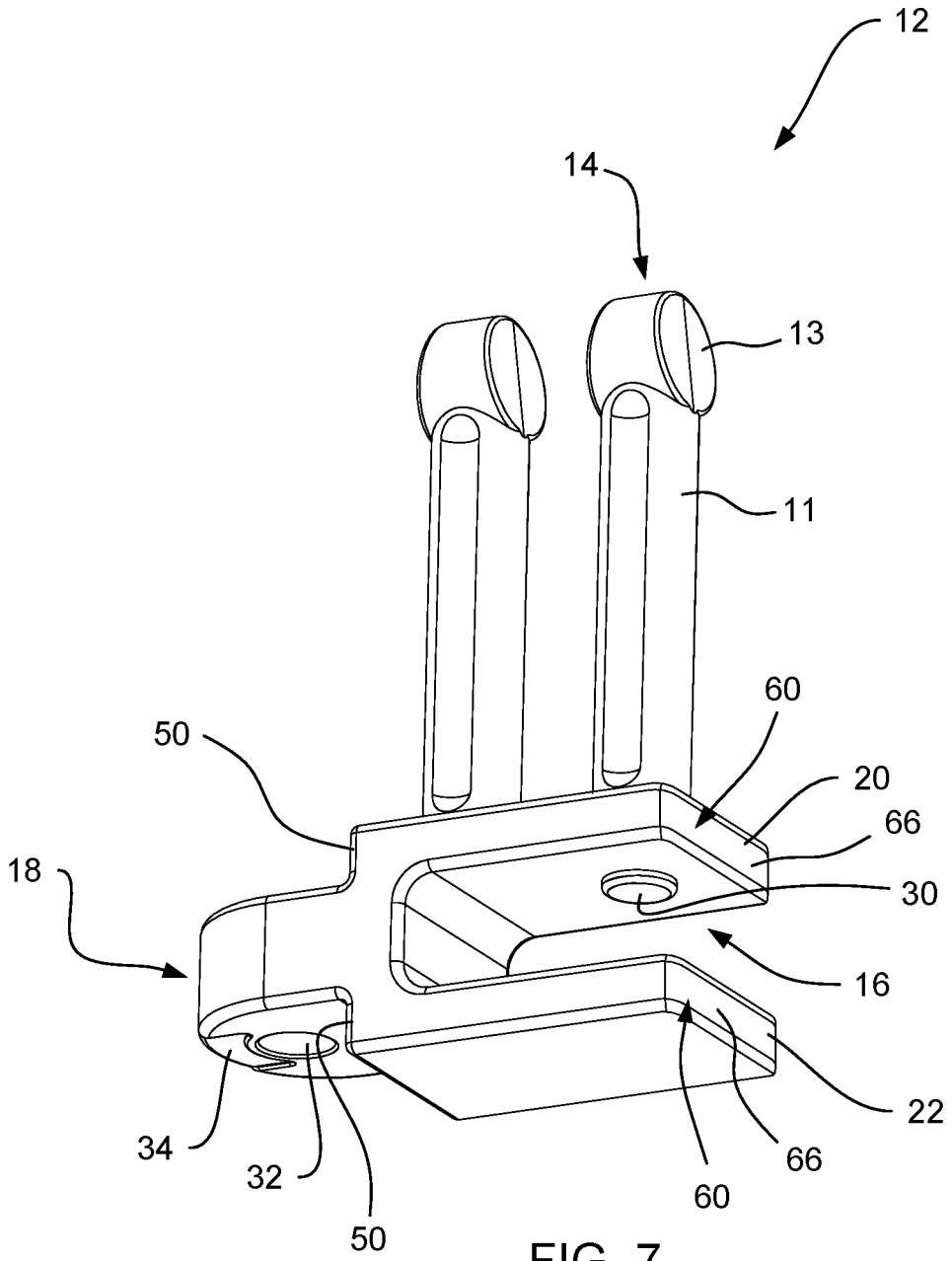
FIG. 7 is a side perspective view of a link according to another example of the disclosed technology.
Figure 8:
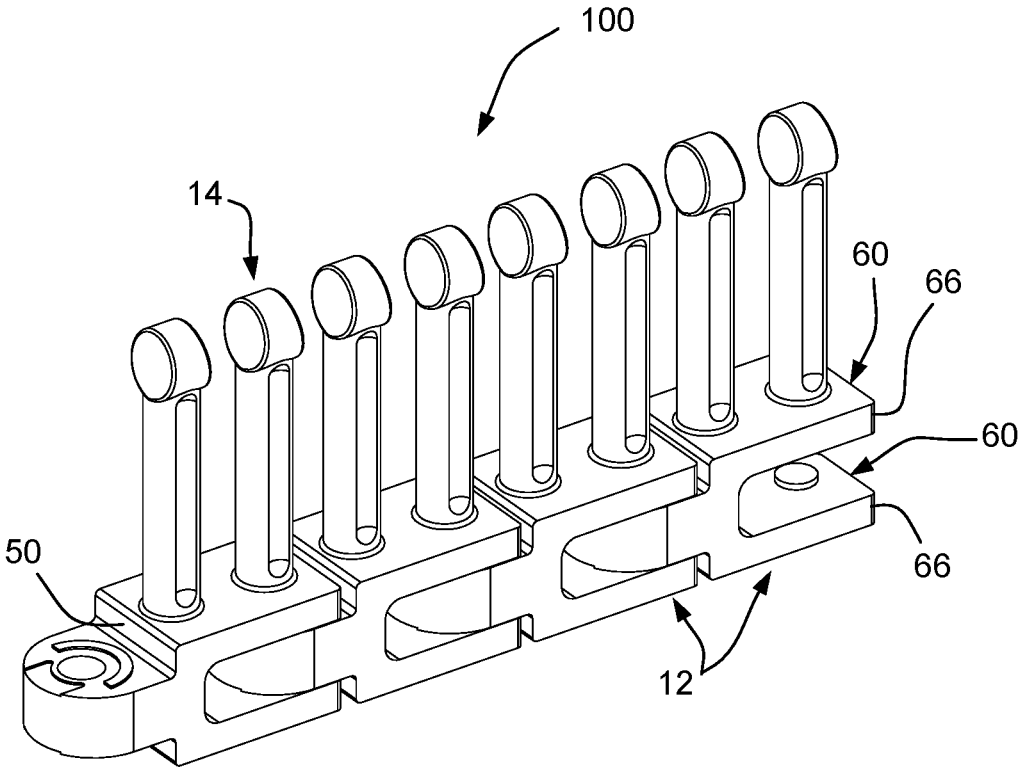
FIG. 8 is a perspective view of a loom according to an example of the disclosed technology.
Figure 9:
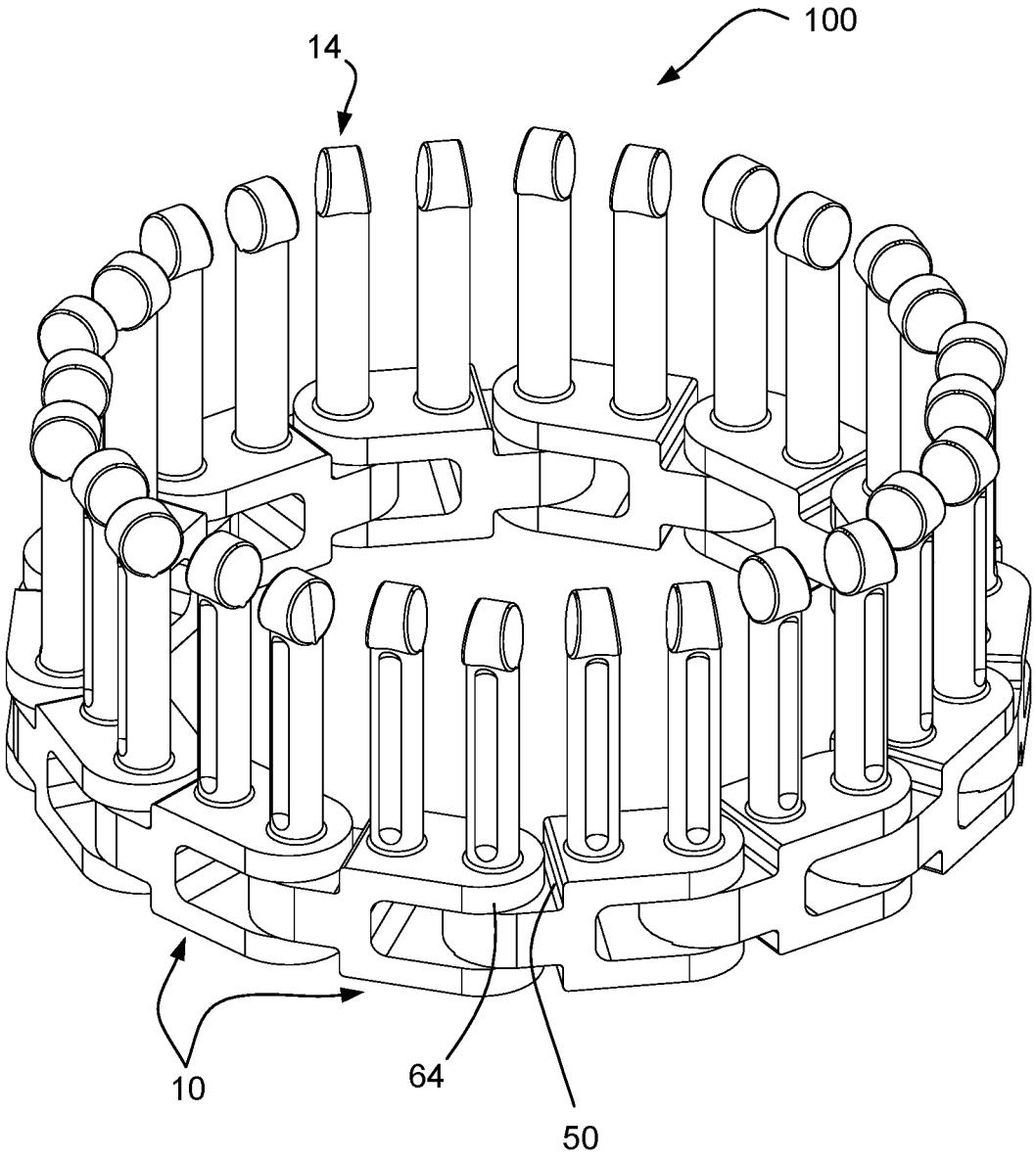
FIG. 9 is a perspective view of a loom according to another example of the disclosed technology.
Figure 10:
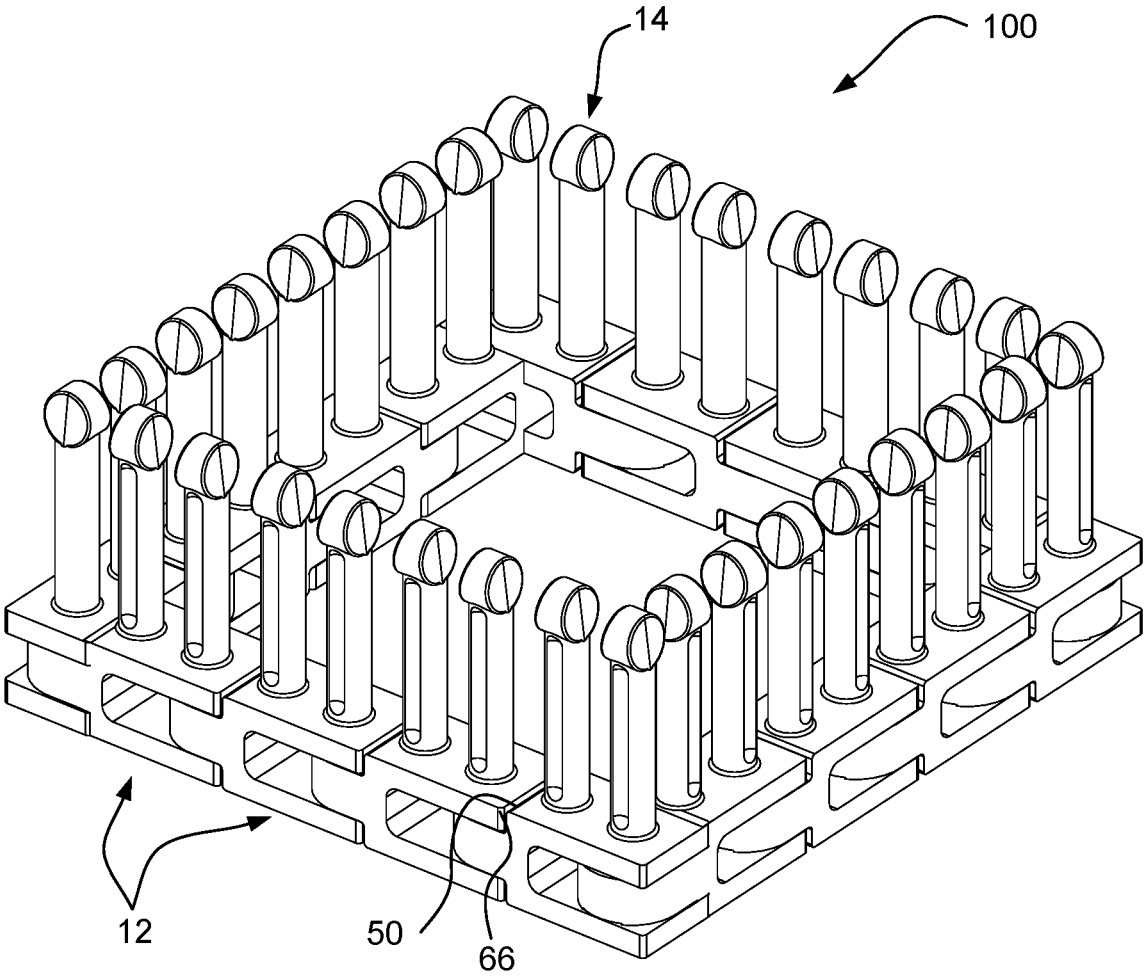
FIG. 10 is a perspective view of a loom according to another example of the disclosed technology.
Figure 11:
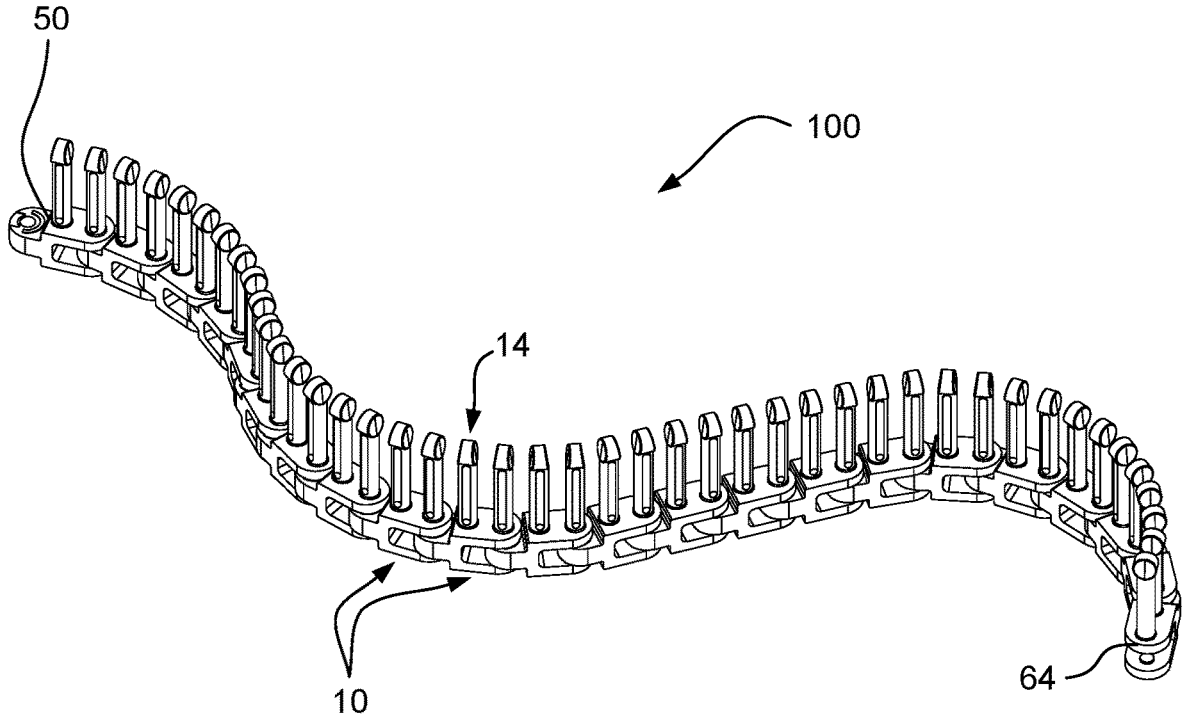
FIG. 11 is a perspective view of a loom according to another example of the disclosed technology.
Figure 12:
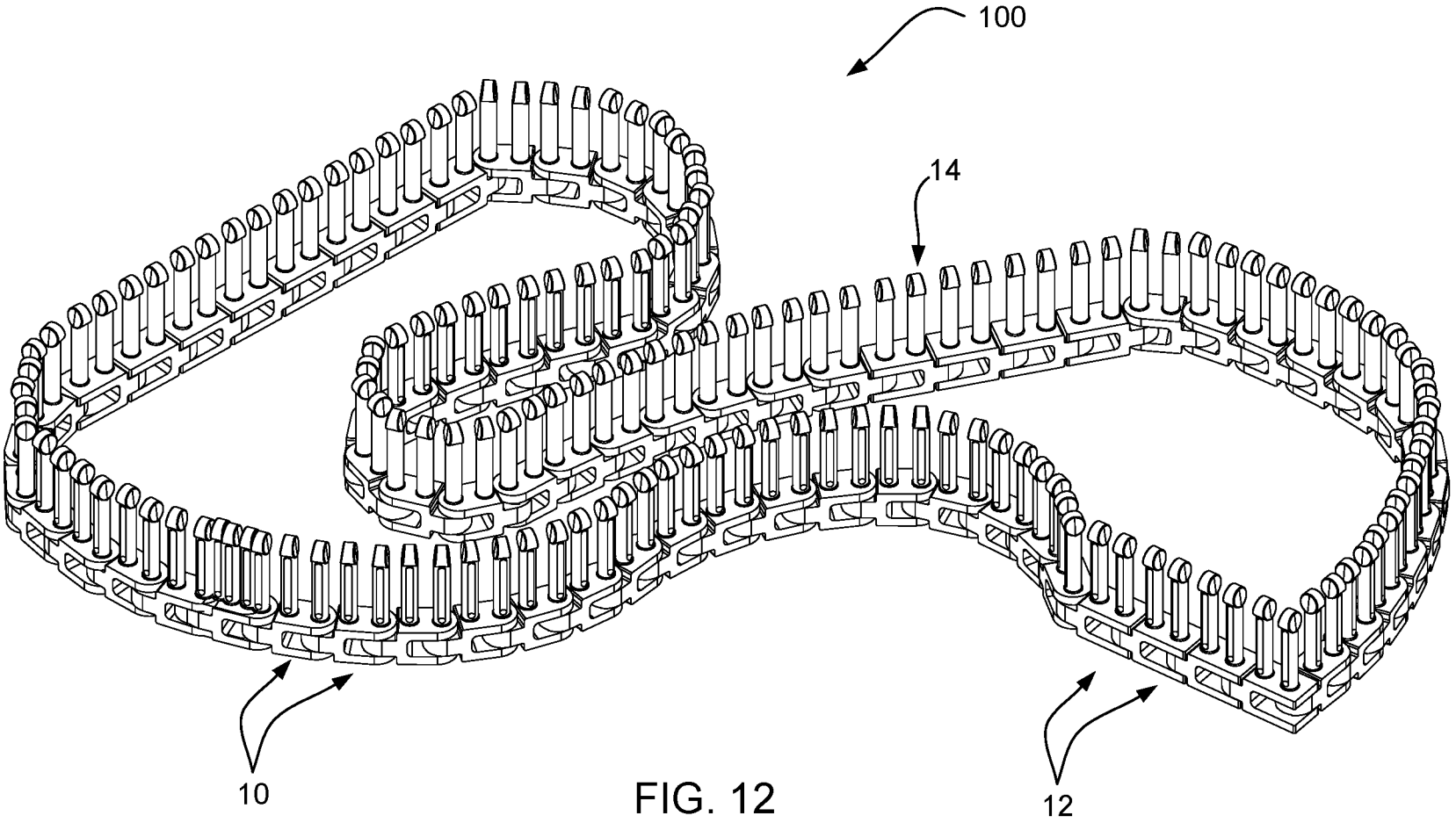
FIG. 12 is a perspective view of a loom according to another example of the disclosed technology.

Referring to FIGS. 8-12, a plurality of different modular hand looms 100 is shown. The modular looms 100 may be constructed from a plurality of links (e.g., relatively small loom parts). As shown in FIGS. 8-12, the looms 100 may be formed, e.g., from rotatable links 10 and/or restricted links 12). Each link may include knitting pegs 14 and may be connected with other links to create a variety of loom shapes (e.g., open shapes such as linear or snake-shape and closed shapes such as circular, round, oval, square, rectangular or irregular loop-shaped). For example, a linear loom 100 is shown in FIG. 8, a circular loom is shown in FIG. 9, a square-shaped loom 100 is shown in FIG. 10, a snake-shaped loom 100 is shown in FIG. 11, and an irregular loop-shaped loom 100 is shown in FIG. 12. Each peg 14 may have an elongate shaft portion 11 and a top portion 13 at an upper end of the shaft portion. The length of the shaft portion 11 is larger than the width of the shaft portion. Also, the top portion 13 may have a width that is larger than a width (e.g., diameter) of the shaft portion 11, as can be seen in FIGS. 1-7, for example.

Once the links are connected to form a loom, some relative movement may remain (and, for example, can be adjusted in degree by usage of different parts from small relative movement to large relative movement) between the links such that the loom is flexible/bendable during use. This may allow the section of the loom not being worked on to be "bunched up" and thus may occupy much less space than a rigid loom with the same number of pegs. This may allow relatively large items, such as blankets, to be created with a loom that takes up less space and is less cumbersome than conventional rigid looms. The flexibility of the loom also provides a malleable hand feel that may be preferable to some users. Additionally, the flexibility of the loom and the modular aspects of the loom allow for easy transport.

Turning to FIGS. 1-7, the loom parts may include links that allow relative rotation with an adjoining link, e.g., rotatable links 10, and links that do not allow (or limit) relative rotation with an adjoining link, e.g., restricted links 12.

Each link may comprise connector structures for connecting with adjacent links. In the illustrated examples, each link includes a first connector structure at a first end portion and a second connector structure at an opposing end portion such that each link may connect to two other links. The first connector structure may be a female connector 16 and the second connector structure may be a male connector 18, as shown in FIGS. 1-7. The female connector 16 may be configured to receive (e.g., by snap fit) the male connector 18 of an adjacent link. The female connector may comprise a slot (or receptacle) between upper 20 and lower 22 portions at one end of the link. By this arrangement, each link is configured to be directly removably connectable to each other link.

Since each link can connect to every other link, the peg count can be changed in small intervals (e.g., by the number of pegs on a single link). For example, in a closed loop configuration, a single peg may be removed while allowing the remaining links to be reconnected into the (slightly smaller) closed loop configuration. Also, the flexibility (rotatability of the links) of the loom allows the links to move relative to one another so as to be arranged into the slightly smaller configuration.

Figure 1:
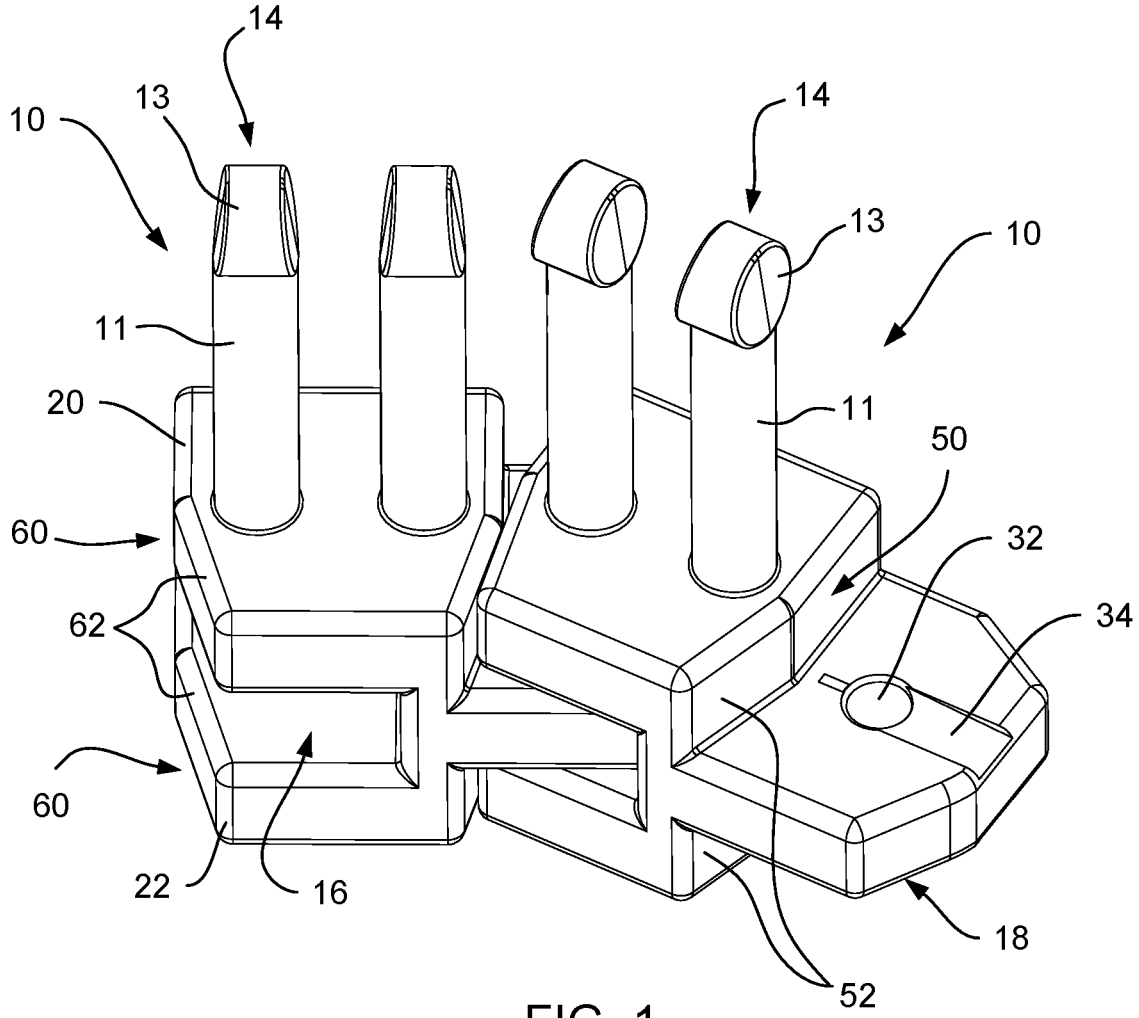
FIG. 1 is a side perspective view of two links connected to one another according to an example of the disclosed technology.
Figure 2:
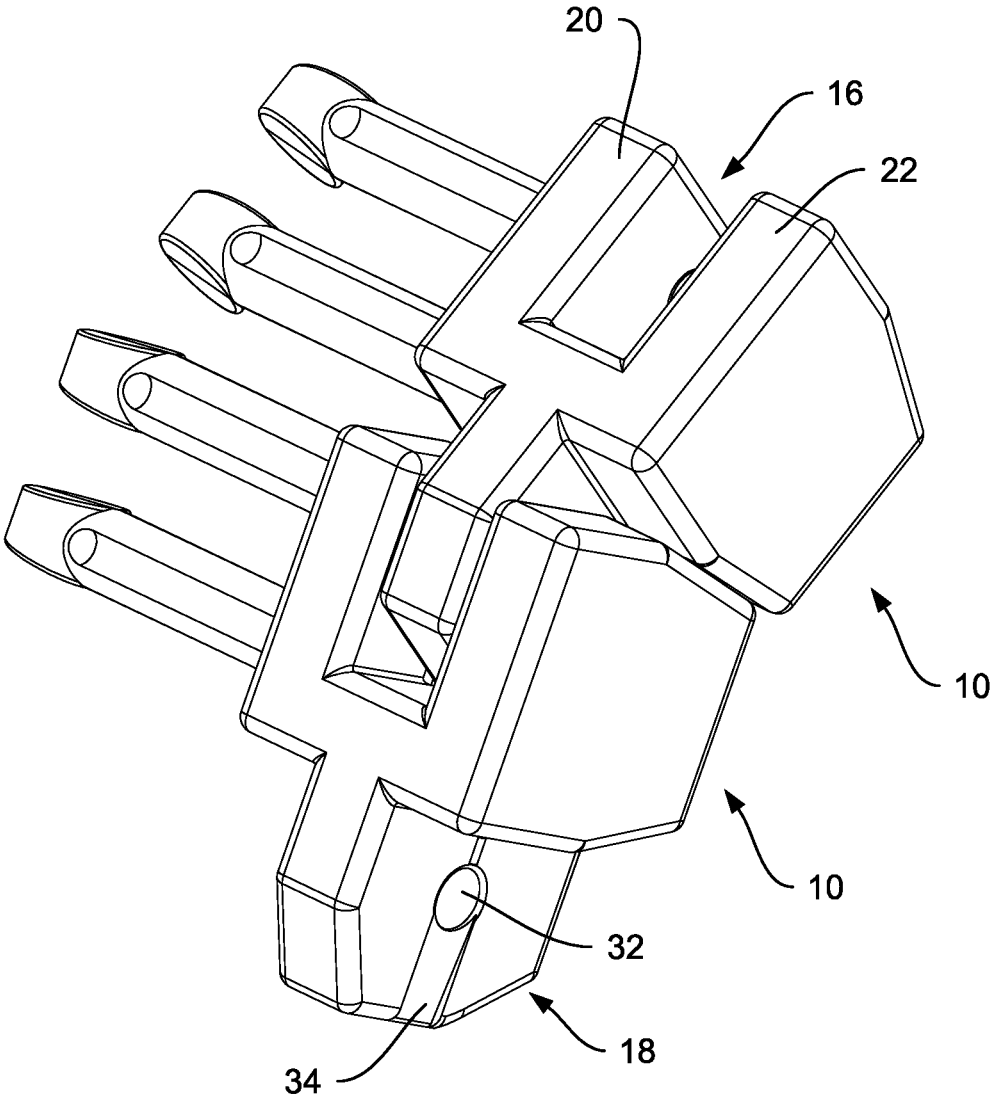
FIG. 2 is a bottom perspective view of the two links of FIG. 1.
Figure 3:
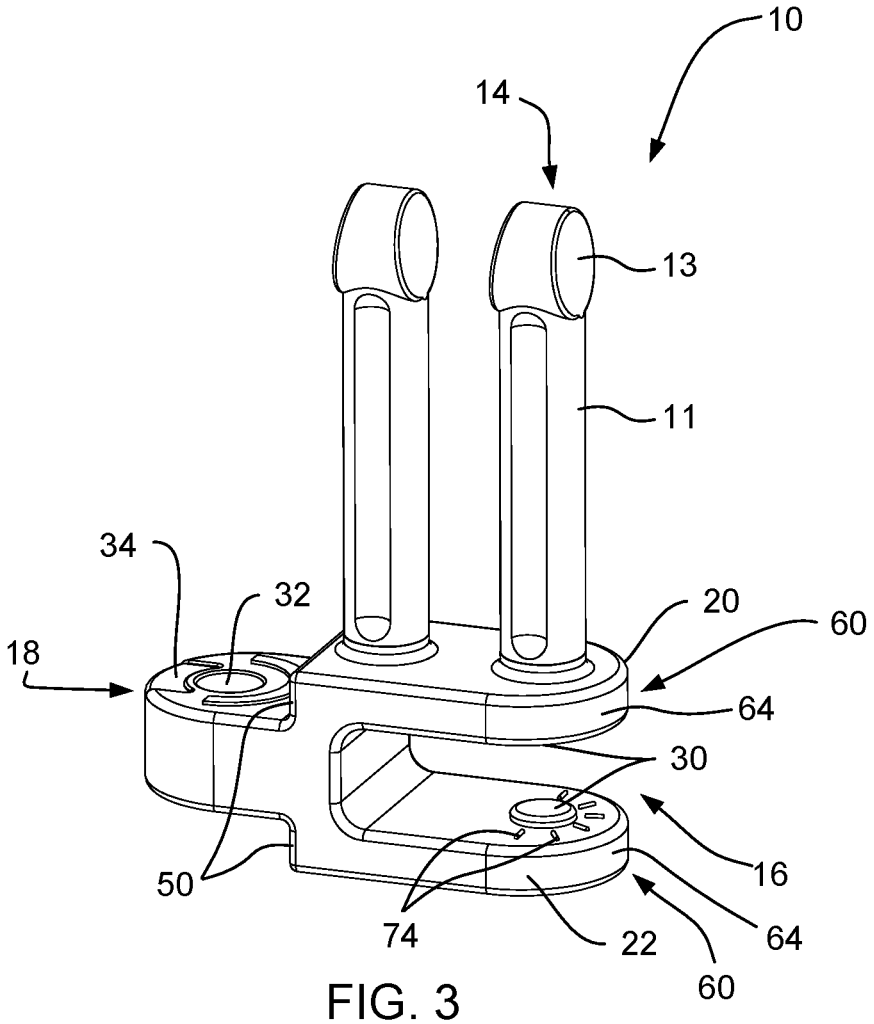
FIG. 3 is a side perspective view of a link according to another example of the disclosed technology.
Figure 4:
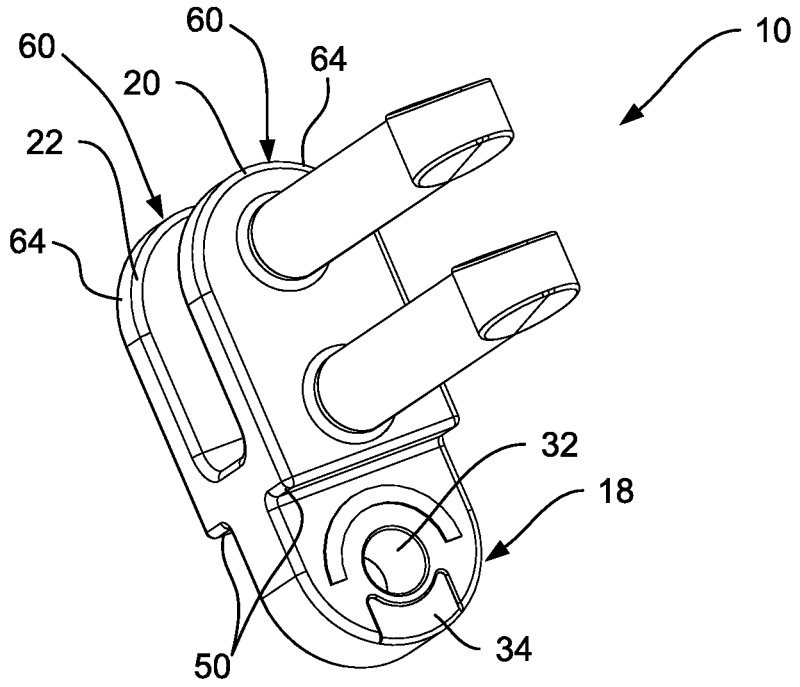
FIG. 4 is a top perspective view of the link of FIG. 3.
Figure 5:
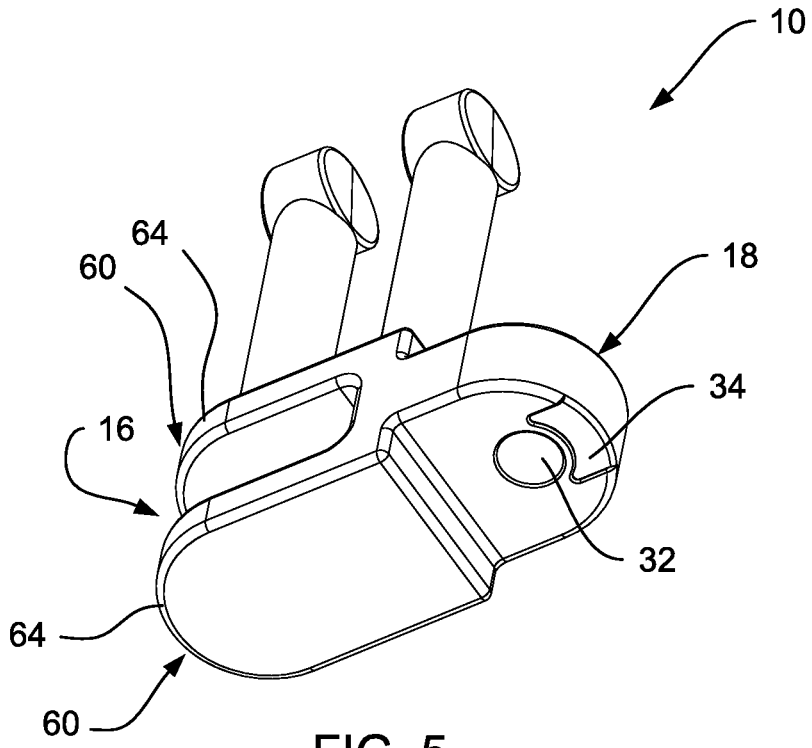
FIG. 5 is a bottom perspective view of the link of FIG. 3.

As shown in the illustrated examples of FIGS. 1-7, protrusions 30 may extend into the area of the slot from opposing upper and lower surfaces, as best shown in FIG. 3. Hole 32 (or suitable non-thru depressions) may be formed in the male connector 18 to receive the protrusions 30 and thus connect two links together. Recess 34 may be formed in one or both surfaces of the male connector end portion to direct the protrusion(s) as they slide toward the hole 32 (or suitable non-thru depressions). Alternatively, instead of hole 32, an open slot may be suitably configured and formed in the male connector end of the links to snap-fit receive the protrusions 30.

The pliability of the links may allow them to be disconnected when moved up and down relative to one another or otherwise forcibly separated. The links may be formed of a suitable material (e.g., conventional plastic material, metal, or wood) (e.g., a thermo-plastic material). Those skilled in the art will recognize that other connector arrangements (e.g., magnets, push levers, hinges, etc.) may be used.

Referring to FIGS. 1-7, one side (e.g., the male connector side) of each link may have a locking face 50, whereas the other side (e.g., the female connector side) may have an active face 60. The locking faces 50 and the active faces 60 of the links 10, 12 may be formed as a surface of a respective link such that when two links are connected to one another the locking face of one link and the active face of the other link will be directly opposed (or abutting) one another. The active face 60 interacts with the locking face 50 to allow or restrict relative rotatable movement between the two links.

For example, as shown in FIGS. 3-7, the locking face 50 is formed as a linear (or non-curved) surface extending across the width of each link (e.g., forming right angles with the parallel lateral side surfaces of the link). Those skilled in the art will understand that the locking face 50 may have other configurations. For example, the locking face could be segmented or discontinuous (e.g., across the width of the link). In other examples, the locking face may be formed as a curved surface, may include multiple surfaces (e.g., multiple linear and/or curved surfaces) or may have some other configuration having a mating arrangement with the active face 60.

In the illustrated examples of FIGS. 3-12, the locking face 50 is a single linear surface. In these examples, the locking face is formed as the vertical portion of a step formed between the protruding male connector 18 and the higher up upper surface of the upper portion 20 on the female connector side of the link. In an example, the locking face 50 may also extend below the male connector as the vertical portion of a step formed between the protruding male connector 18 and the lower surface of the lower portion 22 on the female connector side of the link, as shown in FIG. 3. By this arrangement, the locking face 50 includes a pair of surfaces.

The locking face 50 of a link may interact with the active face 60 of an adjacent link when the two links are connected to one another. As shown in FIGS. 3-6, the active face 60 of the rotatable links 10 may be a rounded surface 64 (e.g., upper and lower portions 20, 22 may have rounded ends). When a rotatable link 10 is connected to an adjacent link, the rounded surface 64 will be directly opposed to the locking face 50 of the adjacent link, as shown in FIGS. 6, 9, 11 and 12. However, the curved nature of the rounded surface 64 permits the rotatable link 10 to rotate (e.g., pivot) relative to the adjacent link, as illustrated in FIG. 6. In an example, the rotatable link 10 may have a range of rotation (angle $\alpha$) up to 180° relative to the adjacent link. In other examples, the range of rotation may be different (e.g., up to 150°, up to 120°, up to 90°, up to 60°, up to 45°, up to 30°, or up to 15°, less than 90°, greater than 45°, greater than 90°, or greater than 180°). In some illustrated loom configurations, such as the irregular loop-shaped loom 100 in FIG. 12, the links may be able to move relative to one another up to 180° during use. It is noted that the links are configured such that the adjacent pegs from respective connected links (1 peg from each link) remain spaced the same distance apart through the full range of rotation.

In an example, some or all of the rotatable links 10 may be configured to limit the rotation of the rotatable links relative to an adjacent link. For example, one or both of the inner surfaces of the female connector 16, i.e., the inner surface of the upper portion 20 and the inner surface of the lower portion 22, may comprise rotation stops 74. As shown in FIG. 3, the rotation stops 74 may be configured, for example, as ribs or elongate protrusions with rounded upper surfaces (the rotation stops 74 on the inner surface of the upper portion 20 are not shown but are the same as the rotation stops 74 on the inner surface of the lower portion 22). Also, as shown in FIG. 6, one or both of the upper surface and lower surface of the male connector IX may have a rotation limiter 76 configured, for example, as a rib or elongate protrusion with a rounded upper surface (the rotation limiter 76 on the lower surface of the male connector 18 is not shown but is the same as the rotation limiter 76 on the upper surface of the male connector).

The rotation stops 74 may be spaced apart in an arc around the protrusion 30 and arranged to engage the rotation limiter 76 to limit rotation of the links relative to one another. In an example, 1 or 2 of the rotation stops 74 may be provided (at any location) and the rotation stops may be configured (e.g., sized) to prevent the rotation limiter 76 from moving past the rotation stops so as to limit the rotation of the links relative to one another. This may give the loom a more rigid hand feel (while still allowing flexibility) which may be desirable to some users.

In another example, any number of rotation stops 74 may be provided (e.g., 1, 2, 3, 4, 5, 5 or more, 10 or less) and the rotation stops 74 may be configured (e.g. sized) to allow the rotation limiter 76 to (e.g., with additional force applied by the user) ride over the rotation stops. This may allow the relative positioning of two links to be adjusted according to a desired loom configuration while allowing limited relative rotatability of the links in the adjusted position which provides the loom with a more rigid hand feel while also providing limited flexibility. That is, within the spaces between the rotation stops 74, the rotation limiter 74 may freely move thereby providing the loom with limited flexibility. To create a different loom configuration requiring a different relative positioning of adjacent links, the user may apply additional force to the links to cause the rotation limiter 76 to ride over one of the rotation stops 74 so as to be positioned between a different set of rotation stops.

In other examples, the spaces between some or all of the rotation stops 74 may be the same size as the width of the rotation limiter 76 so as to completely restrict movement of the rotation limiter 76 when positioned between two such spaced rotation stops 74, thereby preventing relative movement of the links. This arrangement would rigidize the loom providing the loom with a rigid hand feel. In an example, one or more of the spaces between the rotation stops 74 may be the same size as the width of the rotation limiter 76 while one or more of the other spaces between the rotation stop 74 may be sized to allow relative movement between the links.

It should be noted that the rotation stops 74 and the rotation limiter 76 may have rounded upper surfaces that facilitate the rotation limiter 76 in riding over the rotation stops 74. As those skilled in the art will recognize, the rotation stops 74 and rotation limiter 76 could have other configurations and/or arrangements.

As shown in FIG. 7, the active face of the restricted links 12 may be a straight, linear surface 66 (e.g., forming right angles with the parallel lateral side surfaces of the link). When a restricted link 12 is connected to an adjacent link, the straight surface 66 of the restricted link will be directly opposed to the locking face 50 of the adjacent link, as shown in FIGS. 8, 10 and 12. The locking face 50 may be parallel with the active face 60 and positioned directly opposed to the active face such that the two surfaces touch or are disposed with very little space between them. By this arrangement, the locking face 50 and the active face 60 will contact one another upon relative rotary movement of the links thus restricting or preventing such movement, e.g., due to the protruding (e.g., right angle) corner portions.

As shown in FIGS. 3 and 7, a slot separates an upper portion 20 and a lower portion 22 of the female connector 16. Thus, the active faces 60 of the rotatable links 10 and the restricted links 12 may each include a pair of surfaces separated by the slot.

Those skilled in the art will understand that the active face 60 of the rotatable links 10 and restricted links 12 may have other configurations. For example, the active faces could be segmented or discontinuous (e.g., across the width of the link). In other examples, the active faces may include multiple surfaces or may have some other configuration allowing the links to function as discussed in this disclosure. Other arrangements that limit, restrict or adjust the degree of relative movement of the links may also be used. In another example, instead of a rounded shape, the active face 60 of the rotatable links 10 may have angled edge portions 62 (e.g., two surfaces angled relative to one another) to allow relative (but perhaps limited) rotational movement with an adjacent link, as shown in FIGS. 1 and 2. The locking face 50 of the links may have similar angled edge portions 52 (e.g., two surfaces angled relative to one another) to allow limited rotational movement, as shown in FIGS. 1 and 2.

It is noted that multiple different links may be created which may each provide a different degree of relative (e.g., rotational, pivotal) movement with an adjacent link. For example, such links may range from allowing wide free movement to restricted small movement between parts.

As shown in FIGS. 9, 11 and 12, rotatable links 10 and restricted links 12 may be connected together (e.g., using only rotatable links 10 or using both rotatable links 10 and restricted links 12) to form a knitting loom 100 that is flexible and continues to change shape (e.g., by relative movement between the links) while the loom is in use (it is also noted that a flexible loom may also be formed using only restricted links 12 provided the links allow sufficient relative movement between the links). Thus, the knitter can use relatively large peg configurations, for example 100 to 200 pegs, and use relatively little space for the knitting (as compared to the same number of pegs on a rigid loom). That is, once a loom is constructed with a desired number of pegs, the configuration/shape of the loom may continue to change shape during use. In other words, the relative positioning of a group of pegs (e.g., the pegs on a link) with respect to the positioning of a different group(s) of pegs (e.g., the pegs on another link(s)) may continue to change during use. In effect, the spacing between the groups of pegs may be reduced so as to minimize the amount of space that the loom occupies. This permits a certain number of pegs to be contained within a relatively smaller surface area as compared to the same number of pegs on a rigid loom.

This may be particularly advantageous for relatively large items that require a large peg count, such as blankets. Such a loom may be configured in a snake shape (e.g., as shown in FIG. 11) with the user passing the loom across her workspace incrementally such that the pegs/links not being worked on can remain "bunched up" (in a minimal space arrangement) until such time the user pulls those sections across her workspace. Also, this snake shape may be connected at its ends to form a circle or irregular loop-shape which may make the loom easier to maneuver and could also further reduce the space occupied. For example, an irregular loop-shape with a larger number of links is shown in FIG. 12. As those skilled in the art will recognize, a blanket may still be formed with the loop shape by knitting to the last peg and then reversing direction before knitting over to the first peg.

Additionally, pegs can be easily added or removed from the loom (by removing or adding links while knitting) which gives the user a great amount of flexibility in sizing of a finished knit garment. For example, pegs may be added or removed during knitting to create tapers and/or enlarging sections. In an example, pegs (e.g., 2 pegs) may be removed in creating the top part of a hat that has a tapering shape. In another example, pegs may be added when knitting the armhole of a shirt that has an enlarging shape. For example, in a closed loop configuration, a single peg may be removed or added while allowing the remaining links to be reconnected into the (slightly smaller or slightly larger) closed loop configuration. That is, the flexibility of the loom allows the links to move relative to one another so as to be arranged into the slightly smaller or slightly larger configuration.

Looms can be adjusted by small peg intervals (e.g., in this example by 2 pegs), which is great for decreasing or increasing the amount of stitches while knitting. It is also noted that the links may be constructed to have more or less pegs (e.g., 1 peg, 3 pegs, 4 pegs, 5 pegs, 6 pegs, 2 pegs or less, 3 pegs or less, 4 pegs or less, 5 pegs or less, 6 pegs or less, 1 to 3 pegs, 1 to 4 pegs, 2 to 4 pegs, etc.). It is also noted that each link may have the same number of pegs, or the links may have different numbers of pegs such that a first link may have a different number of pegs than a second link. For example, links with an even number of pegs may be provided along with links having an odd number of pegs thereby allowing looms with an even number or an odd number of pegs to be created (e.g., a set of links may have links with two pegs and links with three pegs).

The relatively small size of the links (and relatively small number of pegs per link) allows a variety of different loom shapes to be created from the same group of links. Each link 10, 12 may have a linear arrangement (as opposed to conventional U-shape and L-shape loom pieces) and every peg on each link may be linearly arranged, as shown in FIGS. 1-12. Further, the pegs on each link may be fixedly attached to the link. Additionally, the links may be provided as a kit comprising a plurality of links that may be formed into a plurality of loom configurations. In an example, the plurality of links may comprise at least four (e.g., at least eight) links, and the at least four (e.g., at least eight) links may be connected together to form a plurality of different closed loop loom configurations (e.g., 2, or 3 configurations as shown in FIGS. 9, 10 and 12) (it will be noted that many more (e.g., 5 or more, 10 or more, or 15 or more) closed loop loom configurations (e.g., smaller or larger than those illustrated) may be formed by adding or removing links from the illustrated configurations). That is, using all of the at least four (e.g., at least eight) links, a plurality of different closed loop loom configurations may be formed. In other examples, the plurality of links may comprise at least 12 links, at least 20 links or at least 30 links. Also, it will be noticed that the square shaped configuration in FIG. 10 may be constructed using 4 links (1 link per side) or 8 links (2 links per side). Further, a circle shaped loom smaller than shown in FIG. 9 and an irregular closed loop shaped loom smaller than shown in FIG. 12 may be formed using at least 4 links or at least 8 links.

An additional benefit of the modular flexible loom is that the loom may be arranged into a closed loop configuration for knitting, then disconnected during knitting without removing the partially knitted material from any of the pegs such that the loom pieces can be arranged substantially linearly for easy measuring of the width of the partially knitted material (e.g., blanket), and then reconnected into the closed loop configuration for completion of knitting.

While the examples discussed above have been described in connection with what are presently considered to be practical and preferred features, it is to be understood that appended claims are intended to cover modifications and equivalent arrangements included within the spirit and scope of these examples.

What is claimed is:

1. A modular hand loom, comprising:

a plurality of links being connectable with one another to form a plurality of loom configurations for knitting and/or weaving, each link including elongate knitting pegs, wherein each link has a first end with a first connector and a second end with a second connector, each first connector being removably connectable to the second connector of an adjacent link, wherein the plurality of links includes a first link and a second link, the first link being rotatable relative to the second link when directly connected to the second link, and wherein, when the plurality of links is assembled into a desired loom configuration, the first link is configured to remain rotatable relative to the second link while the first link is connected to the second link, such that the relative positioning of the knitting pegs on the first link is continuously changeable relative to the positioning of the knitting pegs on the second link thereby causing the loom to be flexible during use.

2. The modular loom of claim 1, wherein, due to relative rotation of the first link with respect to the second link, a shape of the loom configuration is continuously changeable during use.

3. The modular loom of claim 1, wherein each link is configured to be directly removably connectable to each other link to form the plurality of loom configurations.

4. The modular loom of claim 1, wherein the first connector of each link is a male connector comprising a protruding member and the second connector of each link is a female connector comprising a receptacle configured to receive the male connector.

5. The modular loom of claim 1, wherein each link has four or less knitting pegs thereon, and every knitting peg on each link is linearly arranged with the other knitting pegs on the link.

6. The modular loom of claim 1, wherein each link has two or less knitting pegs thereon.

7. The modular loom of claim 1, wherein the knitting pegs on each link are fixedly attached to the link prior to the plurality of links being formed into the desired loom configuration.

8. The modular loom of claim 7, wherein each link has the same number of knitting pegs thereon.

9. The modular loom of claim 1, wherein the plurality of loom configurations comprises closed loop loom configurations.

10. The modular loom of claim 1, wherein the first link is a rotatable link having an active face configured to interact with a locking face of the second link to permit rotation of the first link relative to the second link.

11. The modular loom of claim 10, wherein the active face of the first link comprises a rounded surface, and the locking face of the second link comprises a linear surface extending at right angles between parallel lateral side surfaces of the second link.

12. The modular loom of claim 11, wherein the plurality of links includes a third link directly connected to the second link, and wherein the second link is a restricted link having an active face configured to interact with a locking face of the third link to prevent rotation of the second link relative to the third link.

13. The modular loom of claim 1, wherein the plurality of links includes rotatable links and restricted links, each rotatable link being configured to rotate relative to a link adjacent the rotatable link when connected thereto, and each restricted link being configured to rotate relative to a link adjacent the restricted link to a lesser degree than the rotatable links when connected to the link adjacent the restricted link.

14. The modular loom of claim 13, wherein each restricted link is configured to prevent rotation relative to the link adjacent the restricted link when connected to the link adjacent the restricted link.

15. The modular loom of claim 1, wherein the plurality of links comprises at least eight links, and the at least eight links can be connected together to form a plurality of different closed loop loom configurations.

16. The modular loom of claim 15, wherein the plurality of links comprises at least twelve links, and the at least twelve links can be connected together to form a plurality of different closed loop loom configurations.

17. The modular loom of claim 1, wherein each knitting peg has an elongate shaft portion and a top portion at an upper end of the shaft portion, the top portion being wider than the shaft portion.

18. The modular loom of claim 1, wherein each knitting peg has an elongate shaft portion, a length of the shaft portion being larger than a width of the shaft portion.

19. A modular hand loom, comprising:

a plurality of links, each link having elongate knitting pegs thereon for knitting and/or weaving, wherein each link has a first end with a first connector and a second end with a second connector, each first connector being removably connectable to the second connector of an adjacent link, wherein each link is configured to be directly removably connectable to each other link, wherein each link has four or less knitting pegs thereon, and every knitting peg on each link is disposed on the link so as to lie along a common line with every other knitting peg on the link, wherein the plurality of links comprises at least eight links, and the at least eight links can be connected together to form a plurality of different closed loop loom configurations, and wherein the knitting pegs on each link are fixedly attached to the link, prior to the plurality of links being formed into one of the different closed loop loom configurations.

20. The modular loom of claim 19, wherein the at least eight links can be connected together to form at least three different closed loop loom configurations.

21. The modular loom of claim 19, wherein the plurality of links comprises at least twelve links, and the at least twelve links can be connected together to form a plurality of different closed loop loom configurations.

22. The modular loom of claim 19, wherein each link has two or less knitting pegs thereon.

23. The modular loom of claim 22, wherein each link has the same number of knitting pegs thereon.

24. The modular loom of claim 22, wherein, when the at least eight links are connected together to form a first closed loop loom configuration, each link is configured such that any one link of the at least eight links can be removed from the first closed loop loom configuration, while a partially knitted item is disposed on the knitting pegs of the plurality of links, to thereby allow the remaining links of the first closed loop loom configuration to be reconnected into a smaller second closed loop loom configuration, to create a taper in the partially knitted item.

25. The modular loom of claim 22, wherein, when the at least eight links are connected together to form a first closed loop loom configuration, each link is configured such that any two adjacent links of the at least eight links can be disconnected from each other, while a partially knitted item is disposed on the knitting pegs of the plurality of links, to thereby allow an additional link of the plurality of links to be inserted between and connected to the two adjacent links to form a larger second closed loop loom configuration, to create an enlarging section in the partially knitted item.

26. The modular loom of claim 19, wherein each knitting peg has an elongate shaft portion and a top portion at an upper end of the shaft portion, the top portion being wider than the shaft portion.

* * * * *